United States Patent [19]

Kessler et al.

[11] Patent Number: 4,688,619

[45] Date of Patent: Aug. 25, 1987

[54] EXPANDABLE SCREEN

[75] Inventors: Milton Kessler, Youngstown; Myron Ullman, Canfield, both of Ohio

[73] Assignee: Dover Molded Products Co., Dover, Ohio

[21] Appl. No.: 858,522

[22] Filed: Apr. 21, 1986

[51] Int. Cl.[4] ..... E06B 9/52

[52] U.S. Cl. ..... 160/225

[58] Field of Search ..... 160/222–225

[56] References Cited

U.S. PATENT DOCUMENTS

| | | | |
|---|---|---|---|
| 567,828 | 9/1896 | Gordon | 160/225 |
| 1,204,140 | 11/1916 | Eldredge | 160/224 |
| 1,332,924 | 3/1920 | Sikorovsky | 160/225 |
| 1,660,227 | 2/1928 | Levine | 160/225 |
| 2,408,714 | 10/1946 | Whalen | 160/107 |
| 3,431,966 | 3/1969 | Injeski | 160/225 |

*Primary Examiner*—Reinaldo P. Machado

*Attorney, Agent, or Firm*—Browdy and Neimark

[57] ABSTRACT

An expandable screen assembly for positioning within window openings or the like includes a first frame and a second frame, both frames being identical and adjustably secured to one another in an opposing, adjacent relationship by means of frame clips non-integral with the frames. Both frames are adapted for longitudinal movement relative to another, as well as with the frame clips. The expandable screen in beneficial in preventing insects or the like from penetrating window openings or the like. additionally the frame members include cavities for receiving weatherstripping.

17 Claims, 4 Drawing Figures

EXPANDABLE SCREEN

FIELD OF THE INVENTION

The present invention relates to expandable screens for use with window openings or the like, and more particularly expandable screens which are compact, inexpensive and which prevent the entry of insects between the sliding parts.

BACKGROUND OF THE INVENTION

Expandable screens, primarily useful for preventing flys and other insects from penetrating window openings, usually include a pair of adjacent, side-by-side framed screens which are adjustably expandable transversely relative to the window opening. Most of these expandable screens are complex and relatively expensive, requiring tracks or guides built either onto associated window frame members, such as the window's sill or stile, or directly within the screen frames. One sliding screen member is usually of a different construction than the other, thereby increasing the complexity and cost of construction.

For example, the U.S. Pat. No. 813,727 to Marquardt discloses an expandable screen provided with a first screen frame incorporated with dovetailed-ribbed guides for slidably engaging corresponding channels provided in a second, adjacent screen frame. The U.S. Pat. No. 1,701,848 to Hickman also discloses an expandable screen, stated to be particularly useful for automobile windows, including a first screen frame provided with a horizontally extending slot to slidably receive a pin member equipped on a second, adjacent screen fame. These expandable screens, being adjustable, can adapt to window openings of varying widths and eliminate the need for window sill or stile mounted tracks or guides for maintaining the expandable screen within a window opening; in other words, these expandable screens can be positionably lodged within the window frame opening abutted between the window stiles.

While these types of expandble screens are beneficial for trackless placement between window stiles, the screens are equipped with complicated and cumbersome built-in track constructions which prevent simple and quick assemblage of these screens during their installation. Furthermore, these above-mentioned screen types possess an unesthetic exterior appearance, so that the screens are an unattractive window addition to homeowners and the like. In addition, they are unduly complex in construction and therefore expensive to manufacture.

The U.S. Pat. No. 2,408,714 to Whallen discloses an expandable screen including a pair of independent, identical screened frames, both being equipped with brackets or clips which are fastened by screens for cooperation with lower rail of the window sash and for permitting the frames to slide transversely relative to such rail in the window opening. The clips include an L-shaped flanged portion which must be abutted or received by the window sash rail in order for the screened frames to transverse relative to the window opening. This particular expandable screen has many disadvantages. Thus it is only useful when employed in windows of a particular construction.

Insofar as is known, no expandable screen has previously been available which eliminates the need for window stile or sill mounted tracks as well as tracks or guides built directly within the screen frames. Furthermore, there is a great need for an expandable screen frame which is simple in construciton and inexpensive to make, and simple and easy to assemble with other identical screen frames.

SUMMARY OF THE INVENTION

Accordingly, it is an object of the present invention to eliminate the deficiencies of the prior art, such as those set for the above.

It is a further object of the present invention to provide an improved expandable screen.

It is another object of the present invention to provide an expandable screen frame assembly which eliminates the need for window stile or sill mounted tracks, as well as tracks or guides built directly within the screen frames.

It is still another object of the present invention to provide an expandable screen which is quick and easy to assemble.

It is still a further object of the present invention to provide an improved screen frame for use in pairs to provide an expandable screen and which slidably attach together with simple clip elements.

It is yet another object of the present invention to provide an expandable screen assembly which is inexpensive to manufacture.

It is yet a further object of the present invention to provide an expandable screen apparatus which prevents the entry of insects between the sliding members.

Still other objects, features and attendant advantages of the present invention will become apparent to those skilled in the art from a reading of the following detailed description of embodiments constructed in accordance therewith, taken in conjunction with the accompanying drawings, wherein:

DESCRIPTION OF PREFERRED EMBODIMENT

Figure 1:
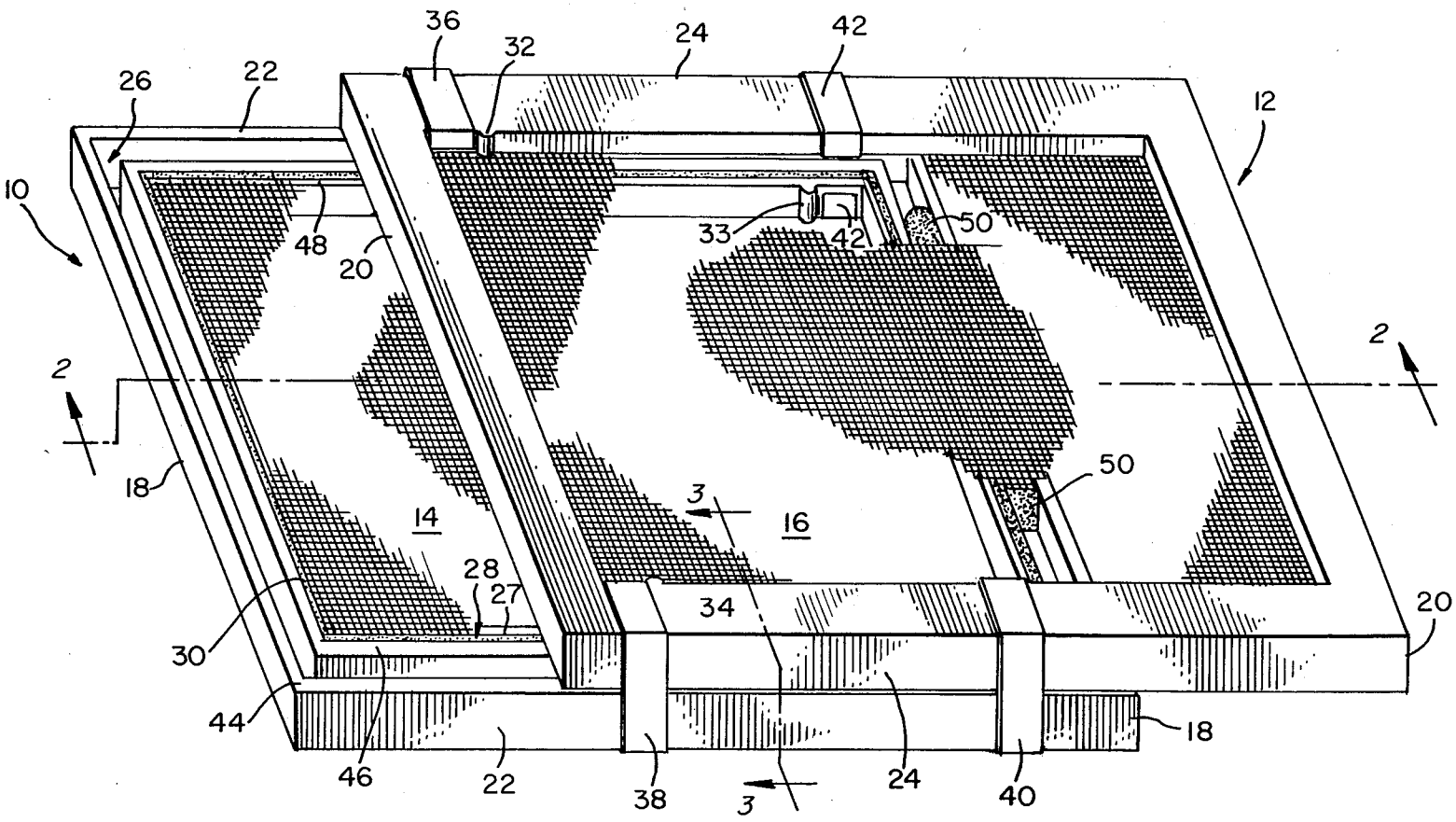
FIG. 1 is a perspective view of a preferred embodiment of the expandable screen assembly of the present invention.

The presently preferred embodiment of the present invention is illustrated in FIG. 1 of the drawings, and comprises the combination of a first screened frame 10 and a second screened frame 12. Frame 10 retains a screen 14 therein and frame 12 retains a screen 16, both frames being structurally identical in face-to-face relationship and having a generally rectangular configuration. While it is contemplated that the invention will find greatest usage where the screen is typical insect screening, such as of aluminum or fiberglass, it should be understood that the term "screen" may encompass all insect imperforate planar barriers, whether gas pervious or not, such as glass, plexiglass, or other like planar sheets which could be retained within frame member 10 and 12.

The first frame 10 includes side members 18,18 and top and bottom members 22,22. Likewise, the second frame 12 includes side members 20,20 and top and bottom members 24,24. All members of both frames are substantially equal in thickness and width and are preferably molded from plastic materials, although the frames could be made from any suitable lightweight material such as wood or aluminum or other like lightweight metals. The frames are preferably injection molded as an entire unit using conventional techniques; however, the frame members can be individually molded, as by extrusion or injection molding, and subsequently assembled in a known way.

Figure 2:
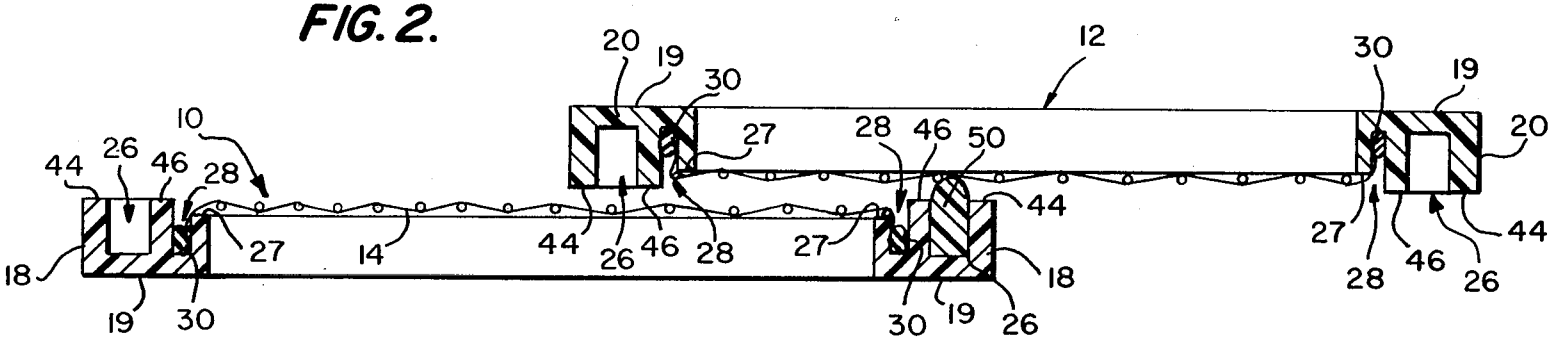
FIG. 2 is a cross-sectional view of the expandable screen assembly taken along the line 2—2 in FIG. 1.

Referring to FIGS. 1 and 2, each frame member is of a substantially E-shaped configuration including an outwardly facing or bottom wall 19, a first exterior leg 44, a second central leg 46, and a third internal leg 27, the latter being substantially smaller in size than the first and second legs 44,46, each leg extending vertically normal from the bottom or outwardly facing wall 19. The space between the first leg 44 and the second leg 46 defines a first cavity 26 for accommodating optional weatherstripping 50 or the like. The space between the second leg 46 and the third leg 27 defines a second cavity 28 for securing the perimeters of the screens 14,16 therein utilizing conventional splining 30. It should be noted that the first cavity 26 is desirably substantially greater in width than the second, screen-retaining, cavity 28.

Figure 3:
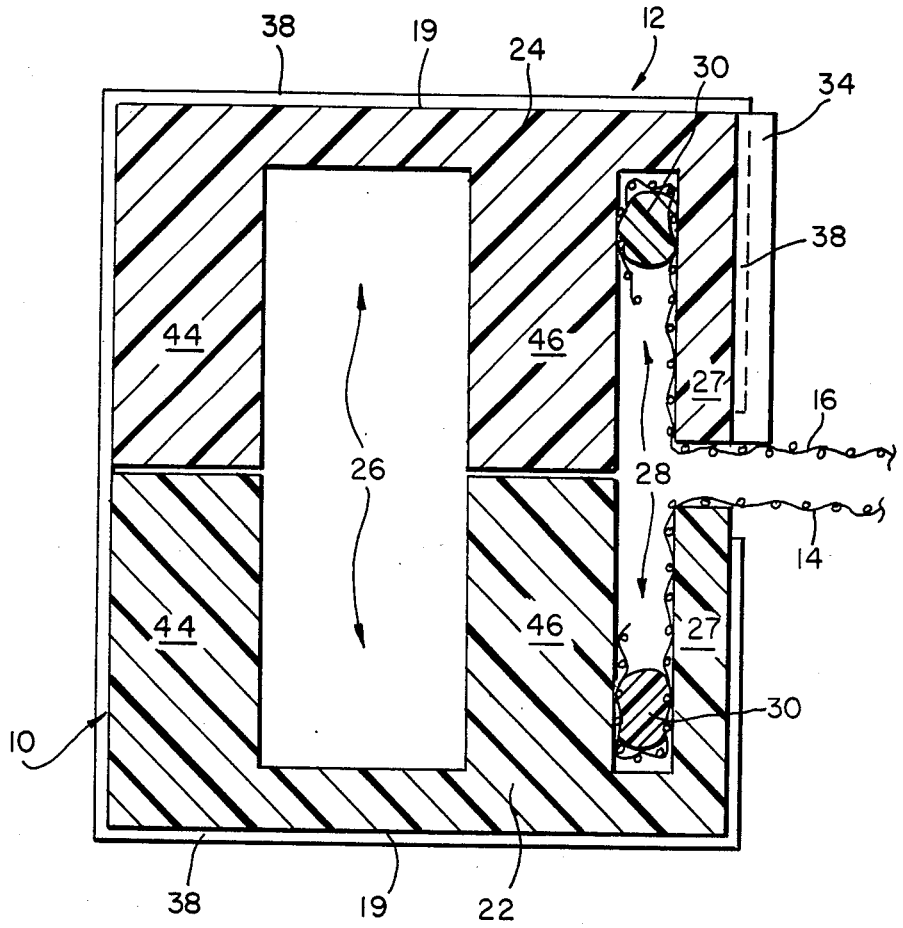
FIG. 3 is a cross-sectional view of the expandable screen assembly taken along the line 3—3 in FIG. 1.

As can best be seen in FIGS. 1 and 3, second frame 12 is equippped along the screen side of top and bottom members 24,24, with integrally molded projecting ribs 32 and 34 which extend vertically normal from the plane of the screen 16 along the entire height of the internal leg 27. The first frame 10 is similarly provided with such ribs, only one of which, i.e. rib 33, is shown. In the illustrated embodiment, the ribs 32–34 are located approximately 1.5 cm from one of the side members, e.g. for the frame 12, the ribs 32 and 34 are spaced 1.5 cm from the side member 20. This spacing is selected to correspond to the width of retaining clips as described below. Each rib 32–34 suitably protrudes approximately 3 mm from the interior surface of the third leg 27 of its respective frame member, and desirably has a thickness of approximately 2 mm.

Ribs 32,33 and 34 constitute stop means for frame clamps or clips 36,38,40 and 42, which fasten first and second frames 10,12 in an adjacent opposing relationship, permitting each frame to slide transversely relative to one another (or when installed, transversely relative to a window opening), while preventing the clips from sliding in an uncontrolled manner. The left side member 20 of frame 12 and the right side member 18 of frame 10 also acts as stop means for frame clamps or clips 36,38,40 and 42, in a stationary position relative to the frame side or member equipped with the projecting rib. For example, clamps 36 and 38 are held stationary relative to frame 12 by means of ribs 32,34 and right side member 20, allowing frame 10 to slide freely between the bottoms of clamps 36 and 38 and the opposing contacting faces of frame 12. Conversely, clamps 40 and 42 are held stationary relative to the frame 10 by means of its ribs including rib 33 and its left side member 18, allowing frame 12 to slide freely between the top portions of clamps 40 and 42 and the opposing faces of frame 10.

It should be understood that other retention means for the clips could be used, such as appropriate recesses in the top and bottom members 22,22 and 24,24. It is also possible, but not preferred, to permit the clips 36,38,40 and 42 to slide freely on all the side members 22,22 and 24,24.

Figure 4:
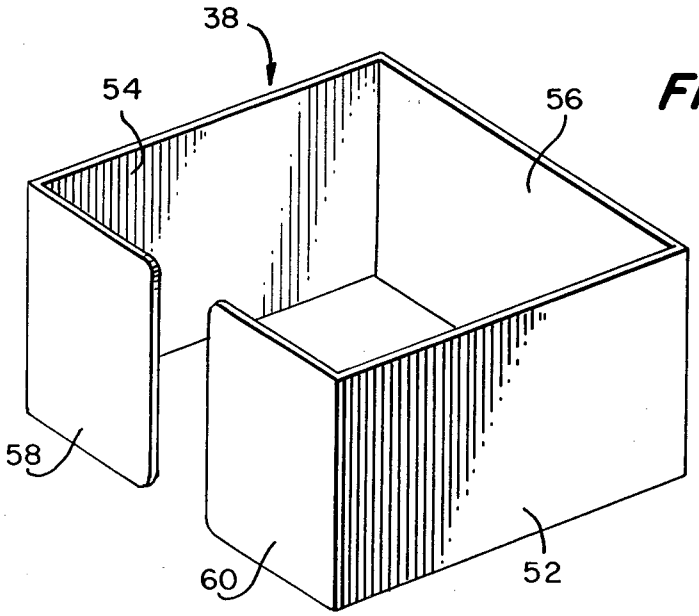
FIG. 4 is a perspective view of the frame clip utilized in conjunction with the present invention.

Referring now to FIG. 4, the clip or frame clamp 38, which is the same as the clips 38,40 and 42, is shown in detail. As can clearly be seen, the clip 38 is generally rectangular in configuration including a top portion 54, a bottom portion 52, a side portion 56, and opposing partially open side portions 58,60. The clamp is preferably made from lightweight metal stock having reasonably good spring properties, but can also be made from semirigid plastic materials or the like, as long as the material used allows the clamp to be flexible enough to fasten around frame members 10 and 12 without permanent deformation. It should be understood that each frame clamp must not have a width greater than the distance between a frame side member and its respective projecting rib on an adjacent frame member. The clamp may be colored similar to that of the frame members, so as to enable the clamp to blend in, facilitating an attractive exterior appearance when the expandable screen is in the assembled mode.

As best illustrated in FIG. 3, clamp 38 virtually surrounds frame members 22,24 enabling frame members 22,24 to be fastened in an opposing adjacent and face-to-face relationship. Both frame members are fastened together, and may be either barely touching each other or may be in tight face-to-face contact, in either event permitting transverse movement of each frame member relative to the other when in the assembled mode. As the frames are preferably injection molded with smooth faces, they are able to slide adjacent one another even if tightly urged together by the clips.

Referring now to FIGS. 1 and 2, a strip or piece of watherstripping 50 is desirably secured, such as by adhesive or sealant, in the cavity 26 of frame member 18 of the frame 10. The weatherstripping 50 extends the full length of the cavity 26 and vertically therefrom contacting the interior face of the screen 16, thereby preventing insects and the like from penetrating whatever gap may exist between the two screens 14 and 16. It should be understood that at most there need only be one weatherstripping member 50 per each expandable screen assembly for preventing penetration of insects and the like between the screened frames. Actually, because the screens 14 and 16 lie very close to the plane of contact between the two frames (see FIG. 2), in many cases not even one weatherstrip 50 is necessary. On the other hand, where the screens 14 and 16 are replaced by imperforate bodies, and the present device is used for insulation purposes, it is desirable to provide weatherstripping in all the cavities 26 of both frames.

Due to the fact that both frames employed in the expandable screen assembly are idential to one another, the expense of manufacturing, packaging and assembling of the screen frames is reduced and difficulty in producing the expandable screen assembly is diminished; for example, one injection mold produces both screen frames.

It will be obvious to those skilled in the art that various changes and modifications may be made without departing from the scope of the invention and the invention is not to be considered limited to what is shown in the drawings and described in the specification. It should also be understood that widths of frame cavities and ribbed projections can have various values, and have the above described dimensions only for purposes of illustrating the present invention.

What is claimed is:

1. An expandable screen assembly for positioning within a window opening or the like, primarily useful for preventing insects and the like from penetrating window openings or the like, comprising:

a first frame for retaining a first insect impervious planar member, lying in a first longitudinal plane;

a second frame for retaining a second insect impervious planar member, lying in a second longitudinal plane parallel to said first longitudinal plane; and retaining means, apart from said first and said second frames, for adjustably securing said first frame to said second frame in an opposing lengthwise adjacent, sliding relationship;

wherein said first and second frames are displaceable lengthwise relative to one another, and at least said first frame is displaceable relative to said retaining means, and wherein at least one of said first frame and said second frame includes at least two stop means for maintaining said retaining means to an opposing frame in a stationary position relative thereto, both of said stop means opposing one another in a direction normal to the lengthwise relative movement of said frames.

2. An expandable screen assembly in accordance with claim 1, wherein said retaining means for adjustably securing said first frame to said second frame comprises a clip.

3. An expandable screen assembly in accordance with claim 2, wherein said clip is of a generally rectangular C-configuration, and is made from a metal stock material having spring properties.

4. An expandable screen assembly in accordance with claim 1, wherein at least one of said stop means of said first frame comprises an integrally molded projecting rib, said rib extending the entire thickness of said frames and extending vertically normal from the length of said frames.

5. An expandable screen assembly in accordance with claim 1, wherein at least one of said stop means of said second frame comprises an integrally molded projecting rib, said rib extending the entire thickness of said frame and extending vertically normal from the length of said frames.

6. An expandable screen assembly in accordance with claim 1, wherein said frames are made of plastic material.

7. An expandable screen assembly for positioning within a window opening or the like, primarily useful for preventing insects and the like from penetrating window openings or the like, comprising:

a first frame for retaining a first insect impervious planar screen member, lying in a first longitudinal plane;

a second frame for retaining a second insect impervious planar screen member, lying in a second longitudinal plane parallel to said first longitudinal plane; and retaining means, paart from said first and said second frames, for adjustably securing said first frame to said second frame in an opposing lengthwise adjacent, sliding relationship;

wherein said first and second frames are displaceable lengthwise relative to one another, and at least said first frame is displaceable relative to said retaining means, and wherein said first and second frames include top and bottom portions and a left-side portion and a right side portion, said portions having a longitudinal axis and having an E-shaped configuration with a first leg, a second leg, a third leg substantially smaller than said first and said second legs, and a bottom wall, all of said legs extending vertically normal from said bottom wall, space between said first leg and said leg defining a first cavity and space between said second leg and said third leg defining a second cavity for receiving screen-retaining splining and said screen's perimeter.

8. An expandable screen assembly in accordance with claim 7 having a piece of weatherstripping in the first cavity, said weatherstripping have a distal surface in sliding contact with a said insect impervious planar member in facing relationship therewith.

9. An expandable screen assembly for positioning within a window opening or the like, comprising:

a first molded plastic screen frame of generally rectangular configuration having a rectangular opening therewithin, said frame including a pair of opposite longitudinally extending side frame members joined at their ends by a pair of opposite transversely extending end frame members, said frame members being of equal thickness and having an interior face lying in a first plane and an exterior face lying in a plane parallel to said first plane, said frame retaining a screen in its rectangular opening, said screen lying close to or within said first plane;

a second frame identical to said first frame and containing a second screen therewithin, said frames being disposed in facing relationship so that said first and second screens lie closely adjacent one another; and retaining means, separate from said first and second frames, for adjustably securing said first frame to said second frame along said opposite lengthwise extending side frame members in an adjacent sliding relationship and for substantially encircling said side frame members in adjacent sliding relationship, said retaining means comprsing four clip members each of a generally rectangular C-configuration with ends lying in the same plane in facing relationship, two of said clip members being provided along one of said side frame members and two clip members being disposed along the opposite side frame members;

wherein said first and second frames are displaceable lengthwise relative to one another.

10. An expandable screen assembly according to claim 9 wherein said frame members are each injection molded as a single, unitary element.

11. An expandable screen assembly according to claim 9 wherein each frame member has a cross-sectional E-configuration including an outwardly facing wall lying in said second plane, an exterior leg extending from said outwardly facing wall along an edge thereof, an internal leg extending from an opposite edge of said outwardly facing wall, said internal leg being of a height which is less than the height of said exterior leg, and a central leg extending from said outwardly facing wall at a location between said exterior leg and said interior leg, said central leg being of a height generally equal to the height of said exterior leg, each said frame member thereby having a first elongated cavity between said exterior and central legs, and a second elongated cavity between said central and internal legs.

12. An expandable screen assembly according to claim 11 wherein the edges of each screen are retained in the second elongated cavity of each frame member.

13. An expandable screen assembly according to claim 11 having a piece of weatherstripping in the first cavity of one of said end frame members extending from said outwardly facing wall between said exterior and central legs and coming into sliding contact with the screen carried by said other frame, said piece of weatherstripping extending the length of said end frame member.

14. An expandable screen assembly according to claim 9, wherein each said frame member comprises a pair of integrally molded stop means for maintaining the position of two of said clip members relative to said frame.

15. An expandable screen assembly for positioning within a window opening or the like, primarily useful for preventing insects and the like from penetrating window openings or the like, comprising:

a first frame for retaining a first insect impervious planar member, lying in a first longitudinal plane;

a second frame for retaining a second insect impervious planar member, lying in a second longitudinal plane parallel to said first longitudinal plane; and retaining means, apart from said first and said second frames, for adjustably securing said first frame to said second frame in an opposing lengthwise adjacent, sliding relationship;

wherein said first and second frames are displaceable lengthwise relative to one another, and at least said first frame is displaceable relative to said retaining means, said frames being made of plastic material;

and wherein each frame member has a cross-section E-configuration including an outwardly facing wall lying in said second plane, an exterior leg extending from said outwardly facing wall along an edge thereof, an internal leg extending from an opposite edge of said outwardly facing wall, said internal leg being of a height which is less than the height of said exterior leg, and a central leg extending from said outwardly facing wall at a location between said exterior leg and said interior leg, said central leg being of a height generally equal to the height of said exterior leg, each said frame member thereby having a first elongated cavity between said exterior and central legs, and a second elongated cavity between said central and internal legs.

16. An expandable screen assembly according to claim 15 wherein the edges of each screen are retained in the second elongated cavity of each frame member.

17. An expandable screen assembly according to claim 15 having a piece of weatherstripping in the first cavity of one of said end frame members extending from said outwardly facing wall between said exterior and central legs and coming into sliding contact with the screen carried by said other frame, said piece of weatherstripping extending the length of said end frame member.

* * * * *